United States Patent [19]

Smith et al.

[11] 4,019,390

[45] Apr. 26, 1977

[54] SYSTEM AND METHOD FOR COMPLETE ON LINE TESTING OF A MECHANICAL OVERSPEED TRIP CHANNEL ASSOCIATED WITH AN ELECTROHYDRAULIC EMERGENCY TRIP SYSTEM FOR A TURBINE POWER PLANT

[75] Inventors: Millard F. Smith, Westown; Frederick J. Behringer, Middletown; John R. Doyle, Collingdale; Daniel P. McFadden, East Goshen, all of Pa.

[73] Assignee: Westinghouse Electric Corporation, Pittsburgh, Pa.

[22] Filed: Apr. 22, 1976

[21] Appl. No.: 679,294

[52] U.S. Cl. ..... 73/432 R; 60/660

[51] Int. Cl.[2] ..... F01K 13/02

[58] Field of Search ..... 73/432 R, 112, 117; 60/660; 415/30

[56] References Cited

UNITED STATES PATENTS

| | | | |
|---|---|---|---|
| 3,692,419 | 9/1972 | Katagiri et al. | 415/30 |
| 3,859,007 | 1/1975 | Kowalski et al. | 415/30 |
| 3,931,714 | 1/1976 | Jaegtnes et al. | 60/660 |

*Primary Examiner*—Herbert Goldstein
*Assistant Examiner*—Joseph W. Roskos
*Attorney, Agent, or Firm*—H. W. Patterson

[57] ABSTRACT

A system and method for complete on line testing of the emergency trip system of a turbine power plant is disclosed. The mechanical trip valve and a portion of a line to drain, of the emergency trip system, are isolated from the remaining portions thereof. The testing of the valve is permitted without an opening to drain of the line, which would cause a turbine trip. A three-way solenoid valve obstructs the line to isolate an upstream portion from a downstream portion while permitting introduction of fluid into the downstream portion at a pressure distinct from that in the isolated upstream portion. Pressure sensitive switches, which operate suitable indications are provided in fluid communication with both portions of the line to drain to sense the differential pressure therebetween upon operation of the solenoid valve and, subsequently, a rapid diminishing of pressure in the downstream portion indicative of a successful test of the mechanical trip valve.

6 Claims, 4 Drawing Figures

SYSTEM AND METHOD FOR COMPLETE ON LINE TESTING OF A MECHANICAL OVERSPEED TRIP CHANNEL ASSOCIATED WITH AN ELECTROHYDRAULIC EMERGENCY TRIP SYSTEM FOR A TURBINE POWER PLANT

BACKGROUND OF THE INVENTION

During the operation of a turbine power plant, there are various conditions which may occur necessitating an immediate shutting down or tripping of the turbine. For example, a loss of electrical load may create a dangerous overspeed condition; low bearing oil pressure may cause excessive wearing and serious malfunction of the turbine bearings; excessive wearing of the thrust bearing results in axial misalignment of the rotating blades resulting in serious internal turbine damage; insufficient condenser vacuum may cause overheating at the last row of turbine blading; or other contingencies may occur where it is necessary to shut down or trip the turbine rapidly to prevent an unsafe operating condition or damage to the turbine power plant.

A failure or delay in shutting off the steam to the turbine in the event of any of the above contingencies may cause extensive damage to various portions of the plant, necessitating expensive repairs and prolonged shutdown. Thus, it is necessary that such a system react quickly to specific contingencies. In a typical steam turbine power plant, hydraulic fluid is pumped at high pressure to a plurality of hydraulically operated valves for controlling steam flow. These valves are designed to open on an increase of oil pressure, and to close on a decrease in oil pressure. Governor valves control the steam flow to the high pressure turbine and interceptor valves control the flow of steam to the intermediate and low pressure turbine stages. Throttle valves which control the flow of steam to the steam chest upstream of the governor valves and reheat stop valves, which control the flow of steam from the reheater section of the steam generator to the intermediate and low pressure turbine stages upstream of the interceptor valves, are provided primarily for protective control of the turbine. The throttle valves are also used for turbine startup. Thus, when tripping the turbine, the throttle valves, governor valves, reheat stop valves, and the interceptor valves are rapidly closed. This is accomplished by releasing the hydraulic fluid pressure to all of the valves simultaneously in response to the detection of any one of several operational contingencies by remote means under control of the operator.

Typically, turbine tripping systems have relied on mechanical hydraulic automatic stopping mechanisms referred to as "autostop systems," to maintain under pressure, the valve control oil for the steam inlet valves. The operation of such systems is described in U.S. Pat. No. 3,931,714 issued Jan. 13, 1976 to which reference is made for a more detailed description thereof. However, as will become apparent herein, as therein, continued reliance on at least an aspect of the operation of such systems is manifestly meritorious in the event that a fail-safe mode of operation is dictated by an unforeseen fault status in the operation of the electrohydraulic trip system disclosed in the referenced U.S. patent.

As a general proposition, in turbine power plants where the controls are automated or controlled from a central office, it is desirable to maintain the reliability and rapid response of the hydraulic system and to eliminate the relatively slow operation, difficulty in adjustment, and limited range of response of the mechanical autostop assembly with its accompanying linkage, except to the extent that retention of portions of the latter provides failsafe operation of the former. Of paramount importance in maintaining uninterrupted operation of the turbine under safe operating conditions while insuring failsafe tripping of the turbine by mechanical means in the event of an unforeseen contingency is the ability to test, on line, the mechanical overspeed trip channel, an autostop system retained in systems more recently developed.

SUMMARY OF THE INVENTION

Broadly, the present invention relates to an improved system and method for insuring reliable operation of the mechanical overspeed trip system provided as a fail-safe backup for an electrohydraulic emergency trip system adapted for closing rapidly the steam inlet valves to a steam turbine in response to any one of the plurality of contingencies. The emergency trip system comprises an electrical portion, an hydraulic portion, certain mechanical autostop subsystems provided as a failsafe backup, a contingency simulation portion, and a central office control panel for testing and monitoring the system. The contingency simulation portion is provided to facilitate testing of electrical and hydraulic portions of the emergency trip. In the presently disclosed system there is provided testing apparatus which may be located on the turbine pedestal or in close proximity thereto to provide failsafe testing of the mechanical autostop system in a local mode.

In accordance with a broad aspect of the present invention there is provided a method for on line testing of an emergency trip system of a turbine power plant including a channel to drain for hydraulic fluid maintained at a predefined pressure, a normally closed valve therein, means for maintaining under fluid pressure the valve closed under normal operating conditions of the turbine, and means for releasing such pressure to open the valve upon the occurrence of a contingency indicative of an unsafe turbine operating condition, the steps of the method comprising isolating an upstream portion of the channel from a downstream portion thereof introducing fluid into the downstream portion of the channel at a pressure distinct from the predefined pressure in the isolated upstream portion thereof, sensing the pressure differential between the upstream and downstream portions of the channel to provide verification of the isolation of the respective portions, operating the means for releasing pressure to open the valve, and sensing the decrease in pressure below a predetermined value to provide verification of operation of the valve.

In accordance with another aspect of the present invention there is provided a system for implementing the method hereinabove described comprising a source of hydraulic fluid maintained at a pressure distince from the pressure in the channel, means defining a flow path from the source to the channel for conveying fluid under pressure from the source to a point of intersection with the channel, means at the point of intersection controllably operable to obstruct the channel for providing isolation of an upstream portion thereof from a downstream portion thereof while establishing a flow of fluid from the flow path into the downstream portion, means interconnecting the upstream and downstream portions for maintaining fluid communication therebetween, first means associated with the interconnecting means for sensing a predefined pressure differential between the upstream and downstream portions of the channel, second means associated with the interconnecting means for sensing in the downstream portion a reduction in pressure below a predetermined value, and means for monitoring the test from initiation to completion thereof, having a first element associated with the first sensing means for providing verification of the isolation of a downstream portion of the channel from the upstream portion thereof and a second element associated with the second sensing means for providing verification of opening of the downstream portion to drain, upon release of the pressure, maintaining the valve in its normally closed position.

DESCRIPTION OF THE PREFERRED EMBODIMENT

Figure 1:
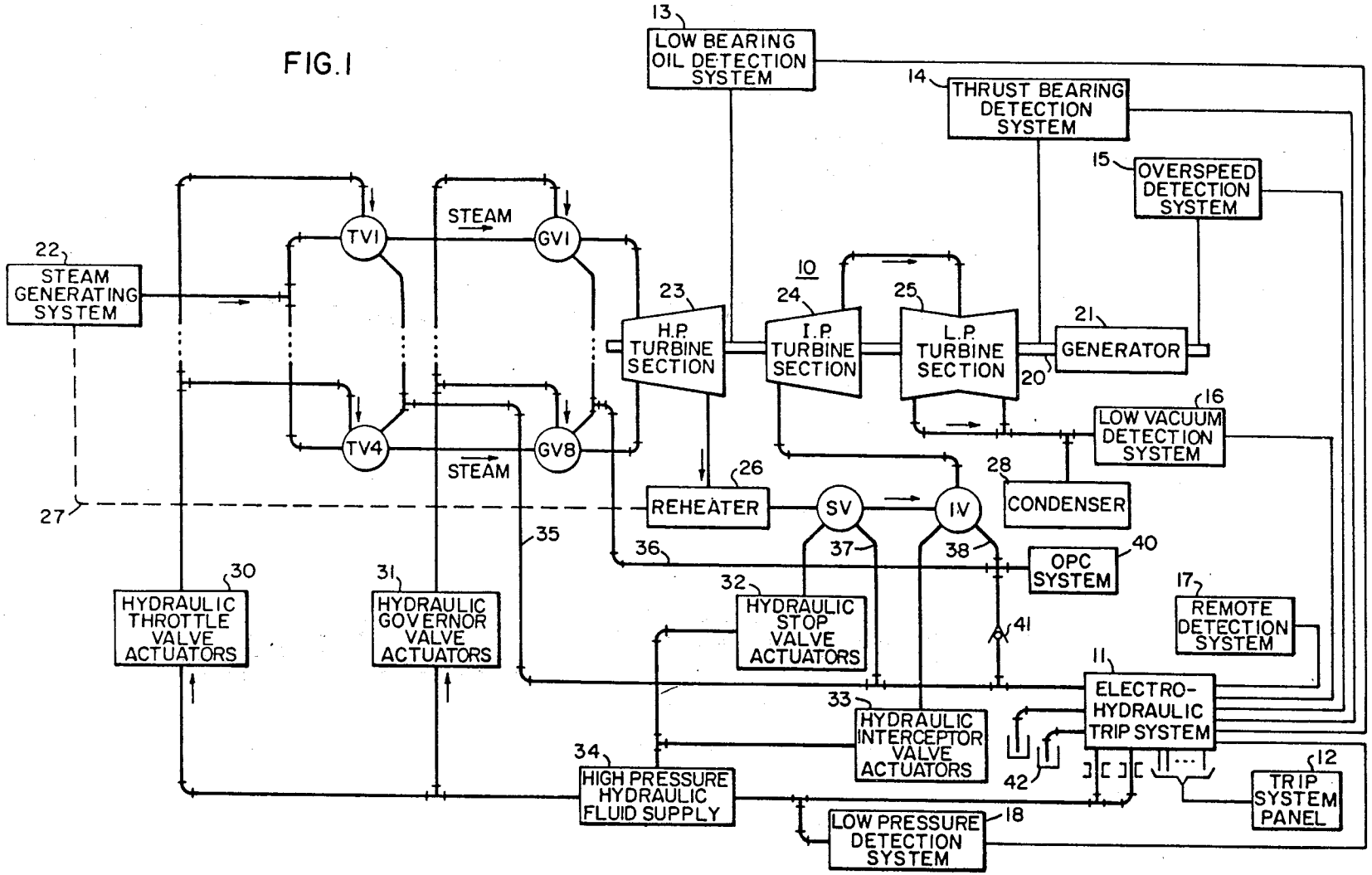
FIG. 1 is a schematic block diagram of a steam turbine power plant employing an emergency trip system in accordance with the principles of the present invention.

Referring to FIG. 1, an electrohydraulic trip system 11, includes a remotely located control and indication trip system panel 12. The trip system 11 operates to rapidly close the steam inlet valves TV, GV, SV and IV upon the occurrence of a malfunction or predetermined operating contingency detected by a low bearing oil detection system 13, a thrust bearing detection system 14, an overspeed detection system 15, or a low vacuum detection system 16, for example. Also a remote detection system 17 may be operated to cause a closing of the steam inlet valves in response to a selected operating contingency which may be located and sensed remote from the turbine installation. A low pressure detection system 18 operates the electrohydraulic system 11 upon the lowering of the hydraulic pressure in the trip system by a predetermined amount. Steam turbine 10 and the steam inlet valves TV, GV, SV and IV are described herein as an environment within which the invention is particularly useful.

To be noted in conjunction with a development of the principles of the present invention is the functioning of the emergency trip system 11 responsive to certain operating contingencies to control both stop valving SV and intercept valving IV. Associated valve actuators 32 and 33, in fluid communication with high pressure hydraulic fluid supply 34 are operated under control of electrohydraulic trip system 11 to achieve emergency control of the valves SV and IV, respectively. Similarly, valve actuators 30 and 31 associated respectively with throttle valves TV1–TV4 and GV1–GV8 and in fluid communication with fluid supply 34 may also be operated under the control of the trip system 11 on the occurrence of an appropriate contingency.

Additional structural and control features of the system of FIG. 1 are more fully described in the above-referenced copending application. Such system is exhibited herein solely for the purpose of providing an appropriate exemplary context within which the present invention may be described.

The turbine trip system panel 12 includes a selector switch (not shown) for individually testing the operating contingencies, such as low hydraulic fluid supply pressure, referred to at 18, low bearing oil pressure, referred to at 13, thrust bearing wear detection, referred to at 14, overspeed detection, referred to at 15, low vacuum detection, referred to at 16, and the remote contingency detection referred to at 17. Panel 12 also includes means for indicating the condition of the emergency trip system.

Figure 2:
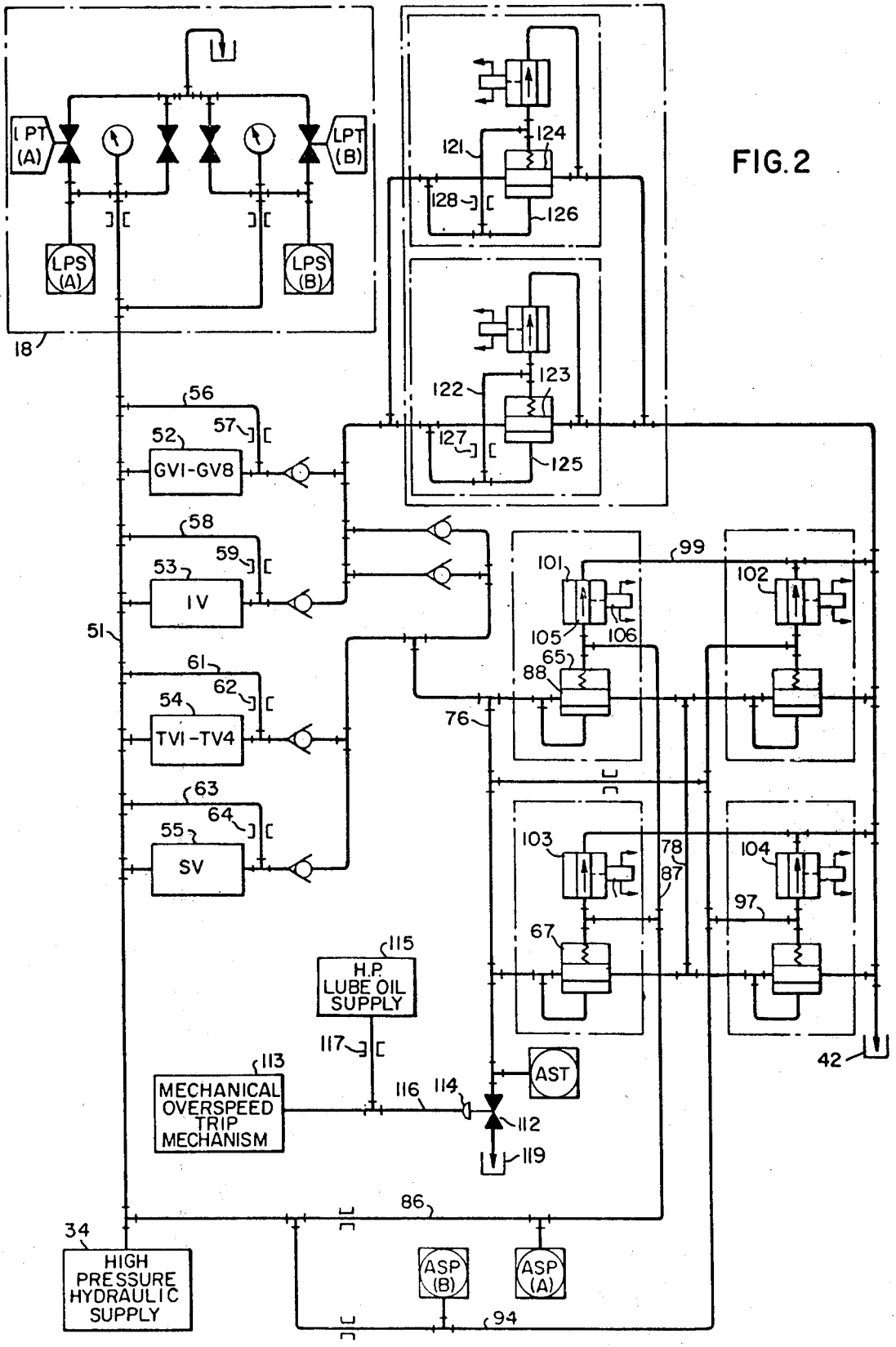
FIG. 2 is a schematic diagram of the hydraulic portion of an emergency trip system illustrating schematically as a portion thereof a system for detecting and testing the hydraulic pressure in a typical trip system within which the on line fail-safe mechanical overspeed channel testing system of the present invention may be incorporated.

Referring to FIG. 2, the electrohydraulic trip system 11 (FIG. 1) includes a hydraulic portion for maintaining a predetermined fluid pressure in communication with the steam inlet valves' operating mechanisms under normal conditions so that the valves can be operated to an open condition; and to decrease such pressure below the trip pressure in response to an abnormal operating contingency for rapidly closing the steam inlet valves.

The hydraulic portion of the system of FIG. 2 includes the high pressure hydraulic supply system 34 which supplies oil under pressure at nominally 2000 lbs./sq. in. in the pipe 51 to the operating mechanism of the steam inlet valves. In FIG. 2, the operating mechanism for each of the valves is shown schematiclaly by block 52 for the governor valves GV1–GV8; by block 53 for the intercept valving IV; by block 54 for the throttle valves TV1–TV4; and be reference numeral 55 for the reheat stop valving SV. Although a single operating mechanism is shown schematically in block form for each type of steam inlet valve, in actual practice, there would be an operating mechanism connection to the high pressure hydraulic supply for each individual valve. The hydraulic pressure required to render the governor valves operative to an open position is supplied from the line 51 through line 56, orifice 57 to the operating mechanism 52. The orifice 57 restricts the flow of oil to an extent whereby a release of pressure on the lower side of the orifice 57 as viewed in the drawing does not effectively decrease the pressure in the pipeline 51. Similarly, fluid under pressure is conducted through pipeline 51, line 58, and orifice 59 to the operating mechanism 53, representative of the intercept valves IV. Also, the throttle valve operating mechanism 54 is subjected to fluid pressure through pipeline 51, pipeline 61 and an orifice 62. Also high pressure hydraulic fluid is conducted through line 51 and line 63 through orifice 64 to the operating mechanism 55 for the reheat stop valving SV. In all instances the pressure of the fluid from source 34 is not effectively reduced in line 51 when pressure is released on the lower side of each of the restrictive orifices 57, 59, 62 and 64.

A plurality of pilot operated solenoid valves AST1, AST2, AST3, and AST4 are so connected in the hydraulic portion of the trip system and with respect to each other to either release the hydraulic pressure downstream of the restricted orifices 57, 59, 62 and 64 for the drain 42 or to block the drain 42 to maintain the predetermined pressure required to operate the steam inlet valves in accordance with the respective open or closed operating condition. The details of the structure, individual function and cooperative association of the valves AST is described in the aforementioned U.S. Pat. No. 3,931,714. In summary, the operation of such complementary arrangement maintains fluid pressure in communication with the operating mechanisms of the steam inlet valves. Fluid pressure is released to drain to rapidly close the steam inlet valves when the pilot operated valve AST1 and the pilot operated valves AST2 or AST4 is open. Also the fluid pressure can be decreased to rapidly close the steam inlet valves when the valve AST1 is in a closed position provided that the valve AST3 and either AST2 or AST4 is in its open position.

The opening of the valves AST1 and AST3 with the valves AST2 and AST4 closed does not release the oil pressure in the hydraulic system. Similarly, the opening of the valves AST2 and AST4 with the valves AST1 and AST3 closed does not release the fluid pressure to the drain 42. The opening and closing of the valves AST1 and AST3 has no effect of the steam inlet valves as long as both valves AST2 and AST4 are closed and likewise the opening of the valves AST2 and AST4 does not release the fluid pressure from the steam inlet valves when valves AST1 and AST3 are closed. A malfunction of any one of the valves AST to an open position will not cause the turbine to trip; nor will a malfunctioning of any such to the closed position prevent the turbine from an emergency trip.

From FIG. 2, together with the detailed description in U.S. Pat. No. 3,931,714 it will be clear that the arrangement and cooperative association of the valves AST is such that under normal turbine operating conditions fluid pressure from fluid pressure supply 34 causes a given portion of each to be held in blocking relation to the drain 42. For example, for valve AST1 the fluid pressure is introduced into the main portion 65 above piston 88 to hold the piston 88 in blocking relationship between pipeline portions 76 and 78 under normal operating conditions.

Each of the valves AST1–AST4 has a pilot portion 101, 102, 103, and 104, respectively for controlling the pressure of the fluid against the piston member of the main portion of its respective valve. Each pilot portion includes a member which is movable to block or unblock the high pressure pilot fluid to the drain 42. Exemplary valve AST1 pilot portion 101 includes a member 105 which is movable to permit the passage of hydraulic pilot fluid from exemplary line 87, through exemplary lines 99 and 97 to the drain 42 upon the deenergization of its solenoid 106. In operation, when the solenoid 106 is deenergized, member 105 permits pipeline 87 to be in communication with the line 77 leading to the drain 42. Also, the energizing of the solenoid 106 moves the member 105 to a blocking position thus permitting the pressure in the line 87 to build up above the member 88, causing the valve AST1 to close.

Thus, turbine tripping upon the occurrence of a predefined contingency referred to hereinabove is accomplished under control of electrohydraulic trip system 11. It will be noted that should the pilot portion of either valve AST1 or AST3 fail to open to release the pilot pressure upon the deenergization of its respective solenoid, the main portions 65 and 67 of such valves will open through the release of pressure by the other valves' pilot portion. Similarly, should either the pilot portion 102 of the valve AST2 or the pilot portion 104 of the valve AST4 fail to open upon the deenergization of its respective solenoid, the valve AST4, or the valve AST2 will open through the pilot portion of its commonly connected valve.

Pressure switches ASPA and ASPB are connected to close the circuit to illuminate corresponding tripped lamps on the control panel 12 upon the release of pressure in lines 86 and 94 respectively, to indicate the opening of the valves AST1–AST4. The pressure switch ASP(A) closes a contact upon the release of pilot pressure by the valves AST1 and AST3; and the pressure switch ASP(B) closes a contact to illuminate a tripped lamp upon the release of pilot pressure by the pilot valves AST2 and AST4. Thus, the operator is informed when the system has responded to a test. The pressure switch AST is connected to operate a trip indication light upon release by mechanical means of pressure in the line 76.

The overspeed protection system 40 (FIG. 1), which releases the hydraulic portion in response to an anticipated overspeed is comprised of normally closed deenergized pilot operated valves OPC1 and OPC2 which operate in a manner similar to the valves AST1–AST4. Upon the energization of the pilot portion of the valves OPC1 or OPC2, the high pressure hydraulic supply is released from the governor valves GV and interceptor valves IV operating mechanisms 52 and 53 only without decreasing the hydraulic pressure to the operating mechanisms 54 and 55 of the throttle valves and reheat stop valves. The pressure in lines 121 and 122 is released upon energization of the valves OPC1 and OPC2, which permits the piston member 123 and 124 to be driven upwardly by the pressure in the lines 125 and 126 that is maintained by restrictive orifices 127 and 128, respectively. The low hydraulic supply pressure detection system denoted at 18 is preferably discussed in connection with the other predetermined operating contingency detection systems. Such discussion is found in Reference (4).

With particular reference to that portion of the system of FIG. 2 within which there is to be incorporated the testing apparatus of the instant invention, the hydraulic trip pressure can also be released via line 76 when diaphragm valve 112 is caused to be open responsive to the operation of a conventional mechanical overspeed trip mechanism 113. The trip mechanism 113 operates to release the pressure above diaphragm or cup portion 114 of the valve 112 created by the high pressure lubricating oil supply system 115. In response to the operation of the overspeed trip mechanism 113, the pressure is released in pipeline portion 116 downstream of restrictive orifice 117, which causes the diaphragm valve 112 to open thereby releasing the pressure in the trip line 76 to the drain 119 to close rapidly the steam inlet valves GV, IV, TV, and SV. This is accomplished without the necessity of operating the solenoid valves AST1–AST4.

Figure 3:
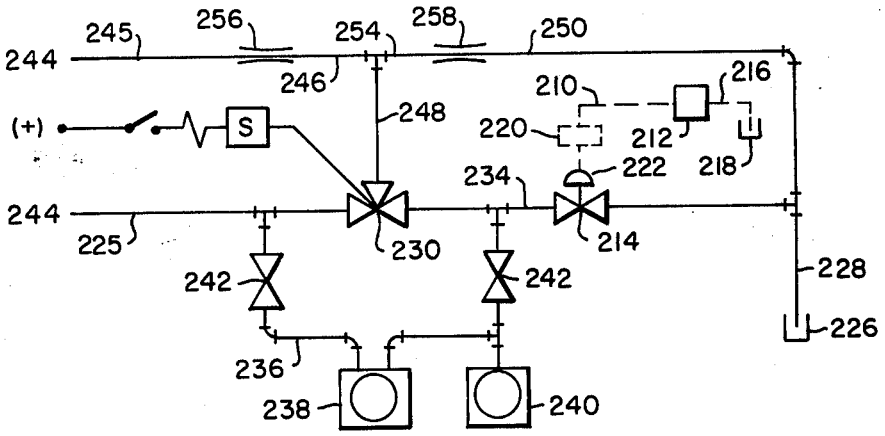
FIG. 3 is a schematic diagram of the on line mechanical overspeed trip channel testing system of the present invention.

Referring to FIG. 3 and with continued reference to FIGS. 1 and 2, there is shown a system which may be incorporated in the emergency trip system 11 of FIG. 1 which provides complete on line testing of the hydraulic portion thereof shown in FIG. 2. More specifically, there is provided a system for insuring the proper functioning of mechanical overspeed trip mechanism 113 upon an emergency contingency without the necessity for taking the turbine off line to test the mechanical trip system in anticipation of the contingency. In that the disclosed system of the present invention has broader application than the specific system partially described in connection with the discussion of FIGS. 1 and 2 and fully disclosed in U.S. Pat. No. 3,931,714 there follows a discussion thereof in a more general context with reference numerals independently assigned commencing with 200 to refer to the system of the present invention. Interfacing with the hydraulic system of FIG. 2 will be described in connection with the discussion of FIG. 4 appearing hereinafter; appropriate correspondence of reference numerals being indicated where applicable.

A typical mechanical overspeed trip channel (comprised of elements 210 through 226) is provided with a testing system 200 adapted for use in a traditional autostop system having an autostop oil supply (not shown) but, rather, being indicated by a line thereof, 210, connected intermediate mechanical device 212 and overspeed diaphragm valve 214. An extension 216 of the line 210 goes to drain 218 which receives the autostop oil upon operation of the mechanical trip 212. In the line 210, isolation means 220 (shown in phantom) has been required in order to maintain pressure in that portion of the line 210 immediately above cup portion 222 of the valve 214 to thereby insure that the cup portion would remain seated during an on line testing of the trip system. Thus operation of the mechanical trip device 212 and an observation that the autostop oil in passing to the drain 218 has reduced pressure in the line 210 to zero provided on an indication that an emergency trip might have occurred given that isolation means 220 had been opened. This did not verify that the cup portion 222 of the diaphragm valve 214 would in fact, unseat upon operation of the mechanical trip device 212. It is considered economically unfeasible to allow the turbine to trip in order that there be a verification that all components of the emergency trip system would function upon the occurrence of an emergency contingency.

It will be apparent from the foregoing that maintenance of pressure in the high pressure trip channel line, indicated generally by the reference numeral 224, is essential in order to avoid unnecessary tripping of the turbine and consequent loss of generated power. The line emanating from reference point 224 will be referred to as the trip header pressure channel or line, and as shown extends to a point above the drain 226 which receives high pressure oil, at nominally 2000 lbs./sq. in., via extension 228 in the event that overspeed trip diaphragm valve 214 is caused to unseat by operation of mechanical trip device 212 upon the occurrence of an emergency contingency.

At the focus of the on line testing system 200 of the mechanical overspeed trip channel defined as being comprised of the elements 210–226 previously described, is a combination of apparatus and a method which employs such apparatus whereby a controllable obstruction, exemplary solenoid operated valve 230, is introduced intermediate the source of high pressure fluid (not shown), indicated as entering the trip channel at reference point 224, and the downstream elements 214, 226 and 228 of the trip channel. By alternative positioning of such means, valve 230, preferably by a locally positioned switch control means assumed to be associated with the solenoid switch shown in the drawing, complete testing of the operation of overspeed trip valve 214 is permitted without interrupting operation of a steam turbine such as that shown schematically in FIG. 1. Local switch control is provided to facilitate operation of the test system in close proximity to the mechanical trip device 212 and independently of a more general and comprehensive turbine control system such as that described.

Viewing the valve 230 as the focus of the system of the present invention, and designating such generically as a three-way solenoid operated valve for convenience, stipulating that functional equivalents thereof may well serve to implement the method to be described hereinafter, a convenient point of reference is established. The trip channel line emanating from the point 224 representative of a trip header pressure source (not shown) will be considered as segmented for purposes of present discussion. That segment intermediate the valve 230 and the reference point 224 will be designated by the reference numeral 232. That segment intermediate the valve 230 and the diaphragm valve 214 will be designated by the reference numeral 234. The numeral 228 associated with the downwardly extending portion may also be considered as referring to the laterally extending segment downstream of the valve 214.

Associated with the trip header pressure line segment 232 is a pressure reference point P1. Associated with the segment 234 is a pressure reference point P2. In accordance with the principles of the present invention, two paths are defined between the two reference points. The first includes the obstruction, valve 230, and the second includes three segments, on extending downwardly from reference point P1, another laterally to a point below reference point P2 and a third upwardly thereto. The second path will be designated by the reference numeral 236. In accordance with the principles of the present invention, the line 236 is provided merely to maintain fluid communication between the channel line segments 232 and 234 and is appropriately sized for that purpose and correspondingly to restrict flow of fluid therein. In the path or line 236 is a differential pressure switch and associated indicator indicated collectively by reference numeral 238 and a standard single valve sensitive switch and associated indicator collectively indicated by the reference numeral 240. Isolation valves 242 are provided for servicing of the line 236, notably repair or replacement of the switches 238 and 240. Under normal operating conditions of the testing system 200, the valves 242 are considered as fully open.

The exemplary valve 230 may be designated by the mnemonic 20/MOST, the differential mechanical overspeed that switch by the mnemonic 63D/MOST and the single value sensitive switch 240 by the mnemonic 63/MOST; the numerals preceding the slash (/) are all standard IEEE designations. As previously noted, the switches 238 and 240 are shown as having associated means for providing a visual indication of their respective settings. Such indicators may be mounted locally on the turbine pedestal or remotely on a test panel such as that to which reference has been made in connection with a discussion of FIG. 2.

In accordance with the principles of the present invention, an additional source of high pressure oil (not shown) nominally 2000 lbs./sq. in. is provided in order to facilitate the on line testing procedure. An entry point into the system 200 will be designated by the reference numeral 244. For ease of reference the line or conduit from the high pressure source into the system 200 will be considered as segmented, having a first segment 246 intermediate the entry point 244 and a point P3 of reference pressure from which there extends downwardly a segment or flow path 248, terminating at an input port of valve 230. A third segment 250 extends from the intersection of segments 246 and 248 or, equivalently, the reference point P3, laterally to a point above the drain 226 and downwardly to a point of intersection with segment 234 of the trip header pressure line. Hereinafter the trip header pressure line will be referred to generally by the reference numeral 225 to distinguish it from the high pressure line comprised of segments 246, 248 and 250, which latter will be referred to generally by the reference numeral 245.

Orifice 256 in the line segment 246 and orifice 258 in the line segment 250 are provided and sized such that a desired pressure drop occurs thereacross. A representative pressure drop would be one from 2000 lbs./sq. in to 1600 lbs./sq. in.

The functioning of the test system 200 will now be described. There will first be discussed the physical principle of the operation of the system 200. There will then be described a complete on line testing of the operation of the overspeed trip diaphragm valve 214, or equivalently, the mechanical overspeed trip channel (210–226), the proper functioning of which depends thereon. The latter discussion will be divided into three phases; (a) initiation of the test, (b) verification of the test, and (c) termination of the test and return of the mechanical overspeed trip channel to its normal state.

Oil is introduced into the line 225 upstream of the arbitrarily selected point 224. The valve 230 is normally positioned open to flow in the channel line 225 such that the nominal pressure of 2000 lbs./sq. in. apparent at 224 is also apparent at P1, P2 and the entry port of the overspeed trip diaphragm valve 214. Thus there is an unobstructed flow path to the valve 214. It is desired to obstruct the channel line 225 for reasons that will become apparent hereinafter. This will be accomplished by operation of the solenoid valve 230. Oil is introduced into the line 245 and experiences a pressure drop across orifice 256 so that pressure in the line segment or flow path 248 is 1600 lbs./sq. in. Consequently, the pressure in line segment 234 is 1600 lbs./sq. in., there being a flow path open between the point 244 and the diaphragm valve 214 by the alternative positioning of the solenoid operated valve 230. Orifice 258 restricts flow in the line segment 250 such that the pressure therein is substantially zero.

Thus, the pressure reference P1 is equal to 2000 lbs./sq. in. The pressure reference P2 is equal to 1600 lbs./sq. in. as is the pressure reference P3. It will be apparent that in any event P2 will equal P3 and that in all instances a differential will exist between P1 and P2 so that the values are exemplary only. The differential selected being 400 lbs., the switch 238 is sensitive to that value and accordingly operates upon the pressure differential in the line 236 incrementing to that value. Thus, a visual indication, typically a light on a panel (not shown) conveys a physical analog, i.e., a predefined pressure differential with the proper functioning of the valve 230. Upon such indication it becomes apparent that trip header pressure will be maintained in the line segment 232 irrespective of what may occur downstream of the valve 230 thus insuring that an unwarranted turbine trip will be avoided during the test.

Opening of the diaphragm valve 214 provides a flow path from the reference point 244 to the drain 226. Thus, P3 (= P2) will rapidly fall off to zero. The visual indication of the closing of the contact at 240 conveys a physical analog, i.e., reduction of the pressure at reference point P2 to an arbitrary setting, for example 1000 lbs./sq. in. with the proper functioning of the diaphragm valve 214.

From the foregoing, the procedure for initiation of the test will be apparent. First the switch of the solenoid valve 230 is operated to block off the trip header pressure line segment 232. Upon observing that the contact or switch 238 has been set by observing an indicator light, it becomes safe to operate mechanical trip device 212 causing cup 222 to unseat, thereby providing a flow path to drain 226.

Verification of the test is provided by illumination of a panel light associated with pressure switch 240. Thus, with illumination of the panel lights 238 and 240, sequentially, responsive to operator action described hereinabove, verification of complete on line testing of the mechanical overspeed trip channel (210–226) is thereby permitted, verification of the unseating of cup portion 222 of the diaphragm 214 upon operation of the mechanical trip device 212 being equivalent thereto.

Return of the mechanical overspeed trip channel (210–226) to its initial state should be accomplished in a stepwise manner. First mechanical trip device 212 is operated to thereby allow pressure in the autostop line 210 to build, forcing cup 222 downwardly, seating to shut off diaphragm valve 214. Upon observing that the panel light associated with pressure contact switch 240 has gone out, it becomes apparent that the switch has assumed its opposite state, thus indicating that pressure in channel line segment 234 has risen rapidly above the low limit, 1000 lbs./sq. in. It then becomes safe to return the valve 230 to its normally open condition, i.e., open to trip header channel pressure line segment 232. Reversing the steps of the test termination procedure would cause an unnecessary trip, thereby defeating the purpose of isolation and testing by introducing the obstruction or solenoid valve 230 into the trip header line in accordance with the principles of the present invention.

Figure 4:
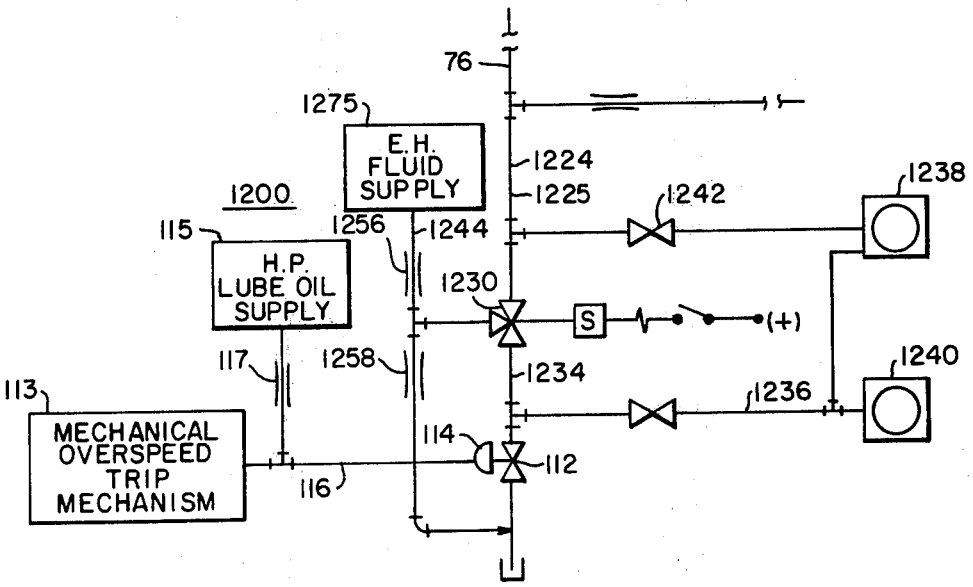
FIG. 4 is a cutaway schematic diagram of a portion of the hydraulic system of FIG. 2 with the system of FIG. 3 incorporated therein for cooperation therewith in accordance with the principles of the present invention.

Referring to FIG. 4, and with continued reference to FIGS. 2 and 3, there is shown the mechanical overspeed trip channel testing system 200 of FIG. 3 (1200 of FIG. 4) within the environment of its immediate application, the hydraulic system of FIG. 2. Only selected portions of the latter system are exhibited and merely for the purpose of demonstrating the manner in which interfacing is accomplished. In that the disclosure of the present invention may be read with that of the system of Reference (4), only a portion of which has been summarized hereinabove, interfacing is exhibited by indicating interconnections and component correspondence with reference numerals to which there has been assigned a high order digit of 1 to avoid ambiguity. Demonstratively, reference point 244 of FIG. 3 becomes 1244 of FIG. 4, an electrohydraulic supply 1275 having been exhibited in accordance with the principles of the present invention previously discussed as preferably operative with an independent high pressure fluid source. Reference point 224 Of FIG. 3 becomes point 1224 of FIG. 4, it being apparent that trip header pressure line 225 can only correspond to that designated by 76 in FIG. 2.

FIG. 4 reveals the desired correspondence of FIGS. 2 and 3 with but a few reference numerals selectively assigned for ease of reference to elements of the system 200 described herein. It will be apparent that certain elements may be combined for the sake of generality. Thus, mechanical overspeed trip mechanism 113, in combination with high pressure lube oil supply 115, encompasses in structure and function elements 210, 212, 216, 218 and 220 of FIG. 3.

While a preferred embodiment of the invention has been described in detail with its incorporation in an exemplary system demonstrated schematically, many changes and modifications within the spirit of the invention would occur for those skilled in the art, particularly in view of its intended adaptability for incorporation within various contexts. All such modifications are considered to fall within the scope of the following claims.

We claim:

1. On line testing apparatus for an emergency trip system of a turbine power plant, the latter including a channel to drain for hydraulic fluid, a normally closed valve therein, means for maintaining under fluid pressure the valve closed under normal operating conditions of the turbine and means for releasing such pressure to open the valve upon the occurrence of a contingency indicative of an unsafe turbine operating condition, the testing apparatus comprising:

a source of hydraulic fluid maintained at a pressure distinct from the pressure in the channel, means defining a flow path from said source to said channel for conveying fluid under pressure from said source to a point of intersection with said channel, means at said point of intersection controllably operable to obstruct the channel for providing isolation of an upstream portion thereof from a downstream portion thereof while establishing a flow of fluid from said flow path into said downstream portion, means interconnecting said upstream and downstream portions for maintaining fluid communication therebetween, first means associated with said interconnecting means of sensing a predefined differential pressure between said upstream and downstream portions of the channel, second means associated with said interconnecting means in said downstream portion for sensing a reduction in pressure below a predetermined value, and means for monitoring the test from initiation to completion thereof having a first element associated with said first sensing means for providing verification of the isolation of the downstream portion of the channel from the upstream portion thereof and a second element associated with said second sensing means for providing verification of opening of the downstream portion to drain upon release of the pressure maintaining the valve in its normally closed position.

2. The apparatus of claim 1 wherein said isolation means is a three-way solenoid valve operable by an associated switch from a normally open position to a closed position to obstruct the channel and establish through an alternative input port a completed flow path from said source into the downstream portion of the channel.

3. The apparatus of claim 2 wherein said switch associated with said solenoid valve has associated therewith an independent control permitting initiation of the test under various operating conditions of the turbine.

4. The apparatus of claim 1 wherein said source of hydraulic fluid is at a predefined point along said flow path remote from said point of intersection with said channel, said remote point defining a point of reference pressure and further comprising a second source of hydraulic fluid maintained at an arbitrary pressure including that of the pressure in the channel, a second flow path extedning from said additional source to said point of reference pressure, means interconnecting said first and said second flow paths, and means in said second flow path for reducing pressure therein to the desired pressure at said point of reference pressure.

5. The apparatus of claim 4 wherein said means for reducing pressure in said second flow path is at least one orifice therein appropriately sized to define said reference pressure.

6. A method for on line testing of an emergency trip system of a turbine power plant including a channel to drain for hydraulic fluid maintained at a predefined pressure, a normally closed valve therein, means for maintaining under fluid pressure the valve closed under normal operating conditions of the turbine and means for releasing such pressure to open the valve upon the occurrence of a contingency indicative of an unsafe turbine operating condition, the steps of the method comprising:

isolating a downstream portion of the channel from an upstream portion thereof, introducing fluid into the downstream portion of the channel at a pressure distinct from the predefined pressure in the isolated upstream portion thereof, sensing the pressure differential between the upstream and downstream portions of the channel, to provide verification of the isolation of the respective portions, operating the means for releasing the pressure to open the valve, and sensing the decrease in pressure below a predetermined valve to provide verification of the operation of the valve.

* * * * *